US007293766B2

(12) United States Patent
Ruthenberg et al.

(10) Patent No.: US 7,293,766 B2
(45) Date of Patent: Nov. 13, 2007

(54) COMPACT BOOKLET MAKER

(75) Inventors: Raymond M. Ruthenberg, Toronto (CA); David C. Van Wyngaarden, Toronto (CA)

(73) Assignee: Xerox Corporation, Stamford, CT (US)

( * ) Notice: Subject to any disclaimer, the term of this patent is extended or adjusted under 35 U.S.C. 154(b) by 300 days.

(21) Appl. No.: 11/180,817

(22) Filed: Jul. 13, 2005

(65) Prior Publication Data

US 2007/0013118 A1 Jan. 18, 2007

(51) Int. Cl.
*B65H 37/04* (2006.01)

(52) U.S. Cl. ..... 270/37; 270/58.07; 270/58.08; 270/58.09; 493/445

(58) Field of Classification Search ..... 270/37, 270/58.07, 58.08, 58.09; 493/445
See application file for complete search history.

(56) References Cited

U.S. PATENT DOCUMENTS

| | | | | |
|---|---|---|---|---|
| 5,316,280 | A | 5/1994 | Watkiss | |
| 6,022,011 | A * | 2/2000 | Hirose | 270/37 |
| 6,217,016 | B1 * | 4/2001 | Honmochi et al. | 270/37 |
| 6,575,446 | B2 * | 6/2003 | Wakabayashi et al. | 270/58.07 |
| 6,799,759 | B1 | 10/2004 | McNamara et al. | |

* cited by examiner

*Primary Examiner*—Gene O. Crawford
*Assistant Examiner*—Leslie A Nicholson, III
(74) *Attorney, Agent, or Firm*—William A. Henry, II

(57) ABSTRACT

An improved booklet maker incorporates a movable backstop for compiling incoming sheets and a stapler and creasing module, which is moved to various positions during the booklet making sequence. The moving stapler and creasing function enables the compiling function to occur simultaneously with the stapling and creasing functions. This results in a productivity gain without a footprint increase.

3 Claims, 9 Drawing Sheets

COMPACT BOOKLET MAKER

This invention relates in general to an image forming apparatus, and more particularly, to an image forming apparatus employing an improved booklet maker.

Conventionally, a booklet maker includes a slot for accumulating signature sheets, as would be produced by a printer. The accumulated sheets, forming the pages of a booklet, are positioned within the stack so that a stapler mechanism and complementary anvil can staple the stack precisely along the intended crease line. In one embodiment, the creased and stapled sheet sets are then pushed, by a blade, completely through crease rolls, to form the final main fold in the finished booklet. The finished booklets are then accumulated in a tray downstream of the crease rolls. U.S. Pat. Nos. 5,316,280 and 6,799,759 B1 disclose examples of such booklet makers.

Current booklet makers found in multi-function finishers combine registration, stapling and folding functions into one module. These systems utilize a variable position backstop and fixed position stapling and folding apparatus. This results in a sequential order of operations that must be completed prior to the arrival of the subsequent media to be compiled. Production market booklet makers typically distribute the registration, stapling and folding functions into separate stations to increase productivity. Productivity is increased in these systems since only one function must be completed prior to the arrival of the subsequent media. However, a disadvantage of these systems is the large footprint required.

Obviously, there is still a need for a compact and productive booklet maker.

Accordingly, an improved booklet maker is disclosed that incorporates a stapler and creasing module, which is moved to various positions during the booklet making sequence. The moving stapler and creasing function enables the compiling function to occur simultaneously with the stapling and creasing functions. This results in a productivity gain without a footprint increase.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific embodiments, including the drawing figures (which are approximately to scale) wherein.

Figure 1:
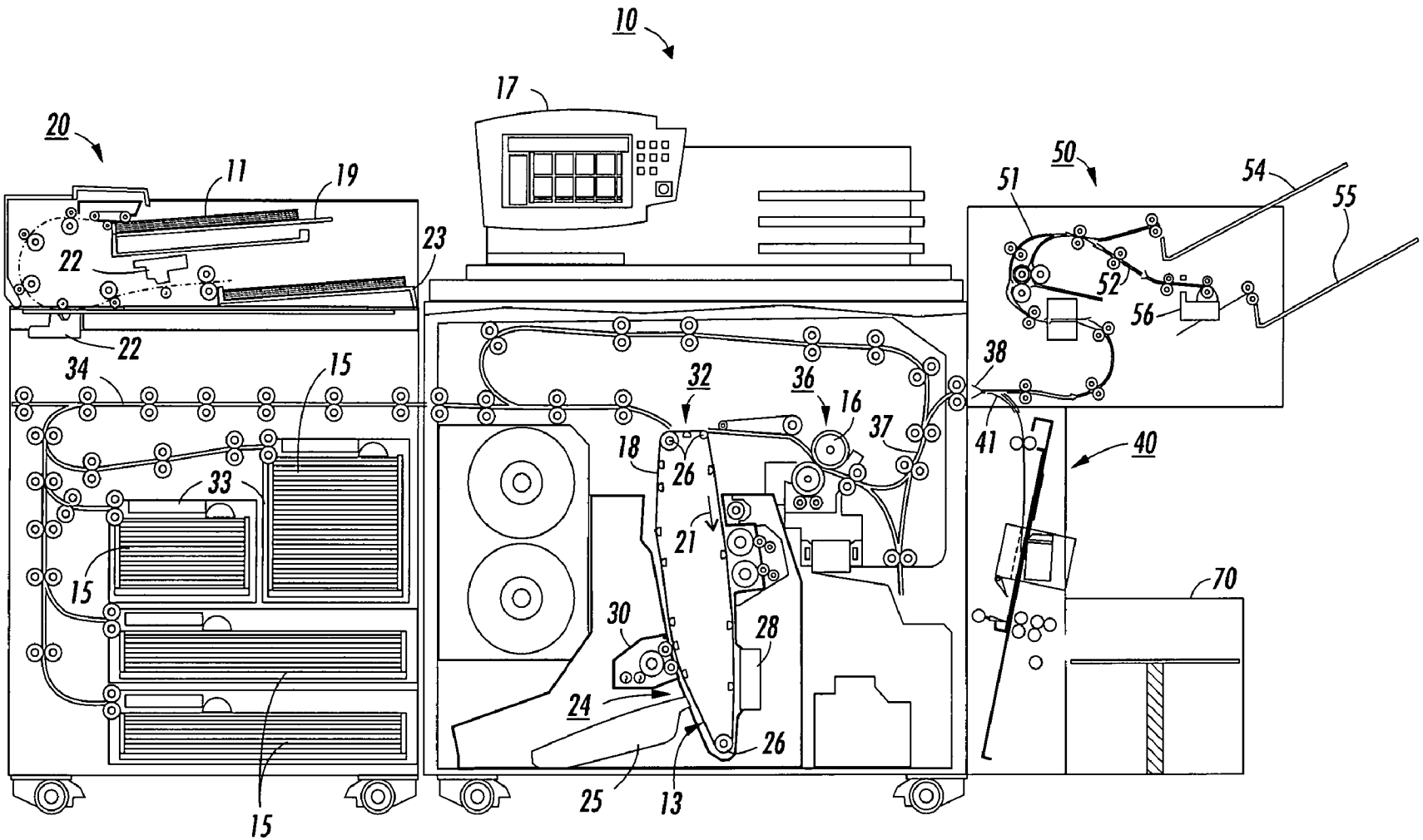
FIG. 1 is an exemplary elevation view of a modular xerographic printer that includes an exemplary booklet maker in accordance with the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes an improved finishing system.

For a general understanding of the features of the disclosure, reference is made to the drawings. In the drawings, like reference numerals have been used throughout to identify identical elements.

Referring to the FIG. 1 printer 10, as in other xerographic machines, as is well known, an electronic document or an electronic or optical image of an original document or set of documents to be reproduced may be projected or scanned onto a charged surface 13 or a photoreceptor belt 18 to form an electrostatic latent image. Optionally, an automatic document feeder 20 (ADF) may be provided to scan at a scanning station 22 paper documents 11 fed from a tray 19 to a tray 23. The latent image is developed with developing material to form a toner image corresponding to the latent image. The toned image is then electrostatically transferred to a final print media material, such as, paper sheets 15, to which it may be permanently fixed by a fusing device 16. The machine user may enter the desired printing and finishing instructions through the graphic user interface (GUI) or control panel 17, or, with a job ticket, an electronic print job description from a remote source, or otherwise.

As the substrate passes out of the nip, it is generally self-stripping except for a very lightweight one. The substrate requires a guide to lead it away from the fuser roll. After separating from the fuser roll, the substrate is free to move along a predetermined path toward the exit of the printer 10 in which the fuser structure apparatus is to be utilized.

The belt photoreceptor 18 here is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and transfer station 32. A sheet 15 is fed from a selected paper tray supply 33 to a sheet transport 34 for travel to the transfer station 32. Paper trays 33 include trays adapted to feed the long edge of sheets first from a tray (LEF) or short edge first (SEF) in order to coincide with the LEF or SEF orientation of documents fed from tray 11 that is adapted to feed documents LEF or SEF depending on a user's desires. Transfer of the toner image to the sheet is effected and the sheet is stripped from the photoreceptor and conveyed to a fusing station 36 having fusing device 16 where the toner image is fused to the sheet. The sheet 15 is then transported by a sheet output transport 37 to a multi-function finishing station 60.

With further reference to FIG. 1, a simplified elevation view of multi-functional finisher 50 is shown including a modular booklet maker 40. Printed signature sheets from the printer 10 are accepted at an entry port 38 and directed to multiple paths and output trays for printed sheets, corresponding to different desired actions, such as stapling, hole-punching and C or Z-folding. It is to be understood that various rollers and other devices which contact and handle sheets within finisher module 50 are driven by various motors, solenoids and other electromechanical devices (not shown), under a control system, such as including a microprocessor (not shown), within the finisher module 50, printer 10, or elsewhere, in a manner generally familiar in the art.

Multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 has a pair of pass-through 100 sheet upside down staplers 56 and is used for most jobs that require stacking or stapling, and the folding destination 40 is used to produce signature booklets, saddle stitched or not, and tri-folded. Sheets that are not to be C-folded, Z-folded or made into booklets or do not require stapling are forwarded along path 51 to top tray 54. Sheets that require stapling are forwarded along path 52, stapled with staplers 56 and deposited into the main tray 55. Conventional, spaced apart, staplers 56 are adapted to provide individual staple placement at either the inboard or outboard position of the sheets, as well as, the ability for dual stapling, where a staple is placed at both the inboard and outboard positions of the same sheets.

Figure 2:
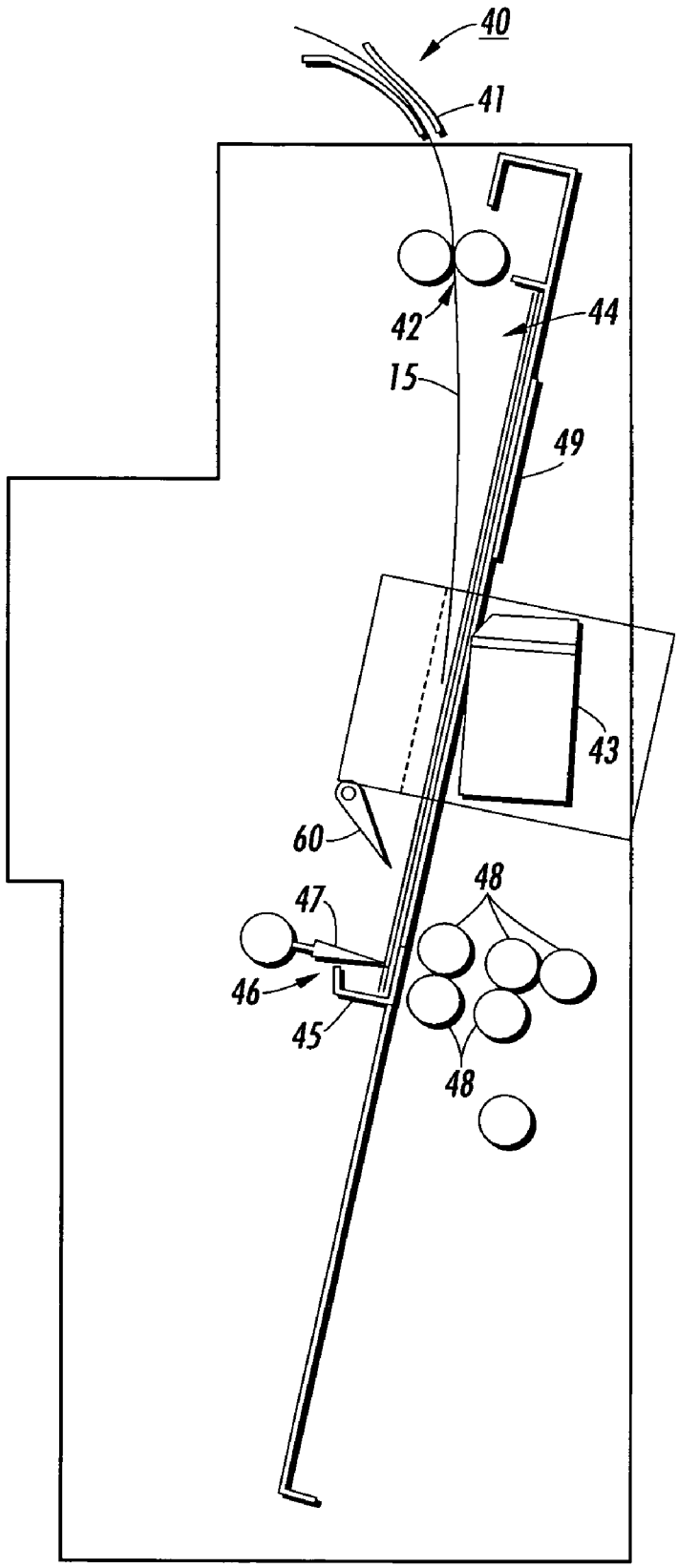
FIG. 2 is an elevation view showing sheets entering the booklet maker shown in of FIG. 1.
Figure 3:
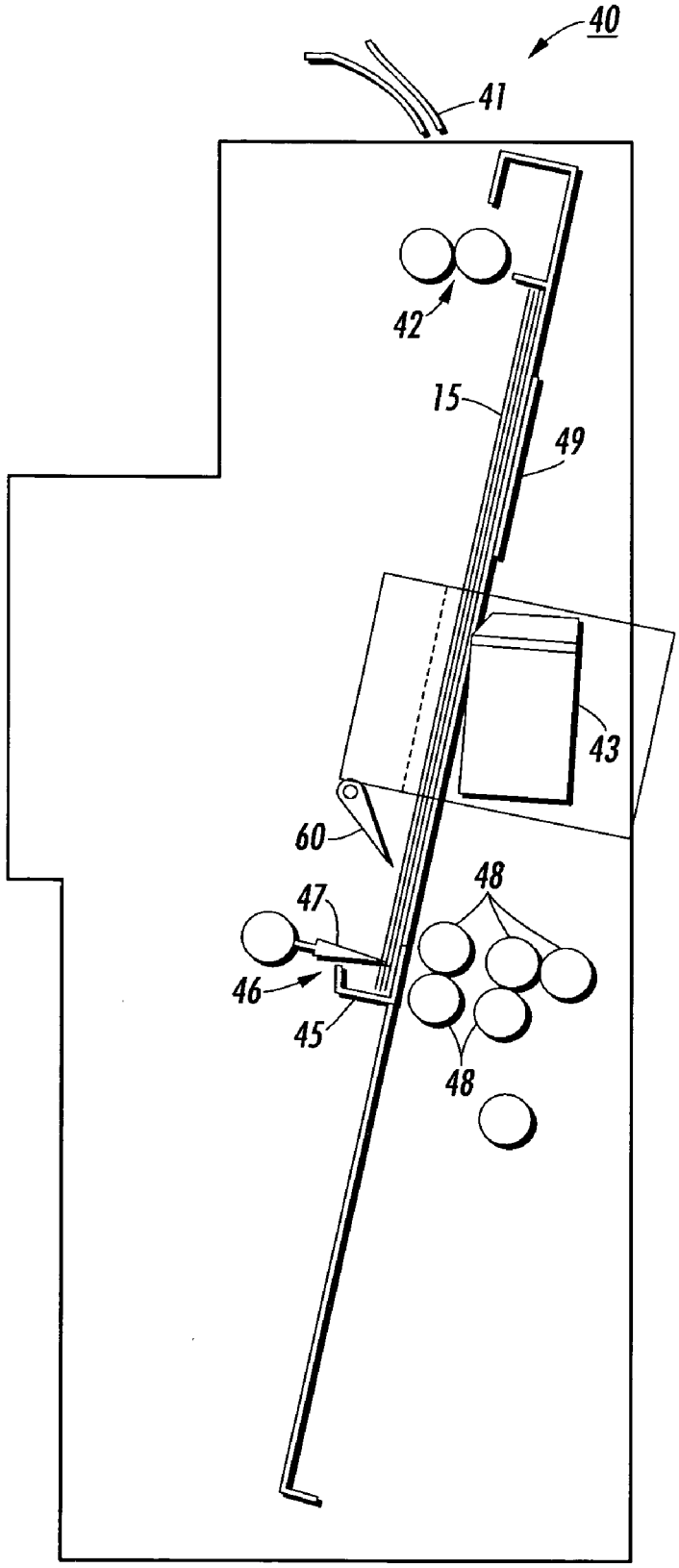
FIG. 3 is an elevation view of the booklet maker of FIG. 1 showing sheets compiled therein.

With booklet making as a requirement, folding and booklet maker 40 in FIGS. 2 and 3 defines an inlet baffle 41 that directs sheets 15 into drive nip 42. Drive nip 42 directs the sheets into an inclined compiling cavity 44 over which are positioned a stapler 43 and crease module 46. The trail edge of each sheet is controlled conventionally using either foam rolls or a sheet order gate (not shown). The signature sheets (each having four page images thereon, for eventual folding into pages of the booklet) are driven into the compiling cavity against a backstop 45. Backstop 45 is adapted to move relative to stapler 43 and crease module 46 and is used to position and control a compiled set of sheets for stapling and creasing. Sheets enter the compiling cavity 44 with the stapler and crease module in an upper position and a tamper 49 in a retracted position. Compiling continues until a set of sheets is accumulated and the lead edge of the last sheet of the set is acquired by backstop 45.

Figure 4:
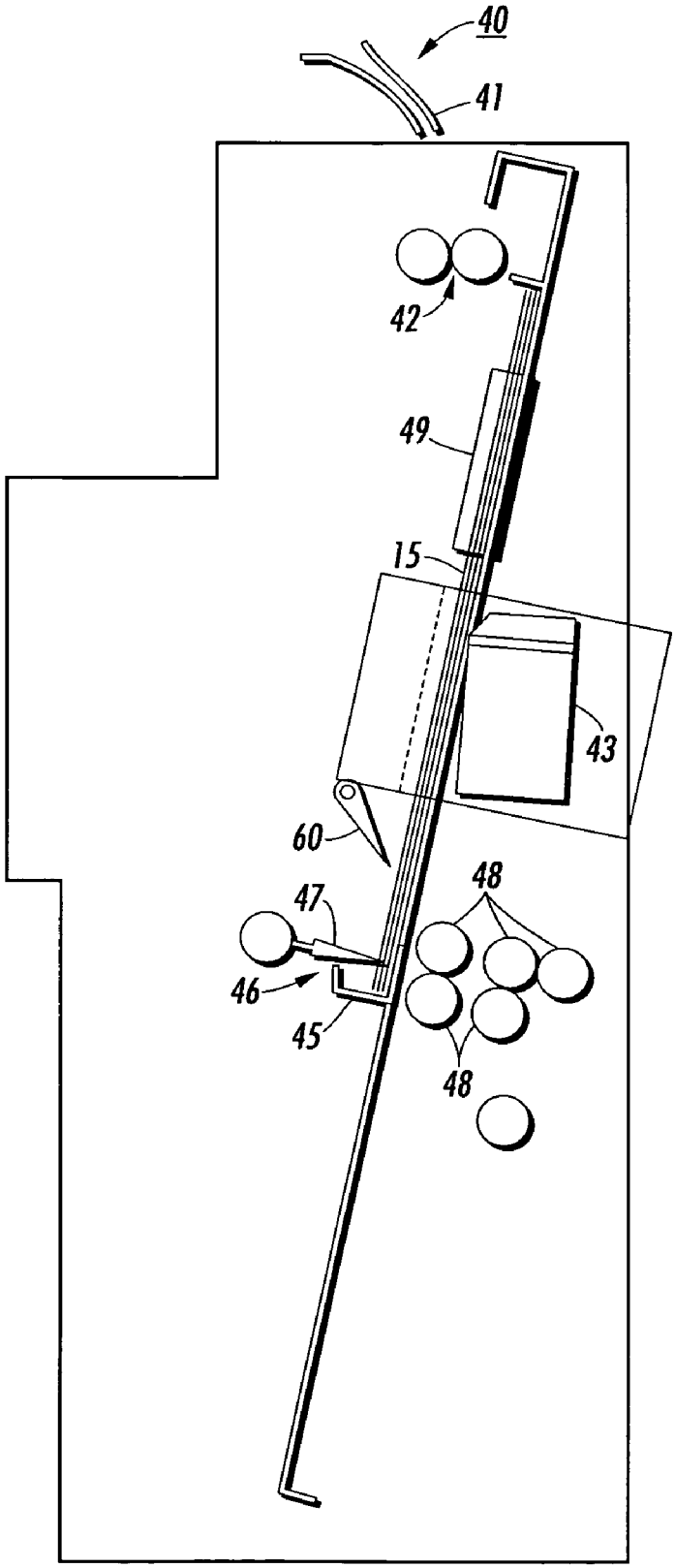
FIG. 4 is an elevation view of the booklet maker of FIG. 1 showing a backstop positioning the sheet set for stapling.
Figure 5:
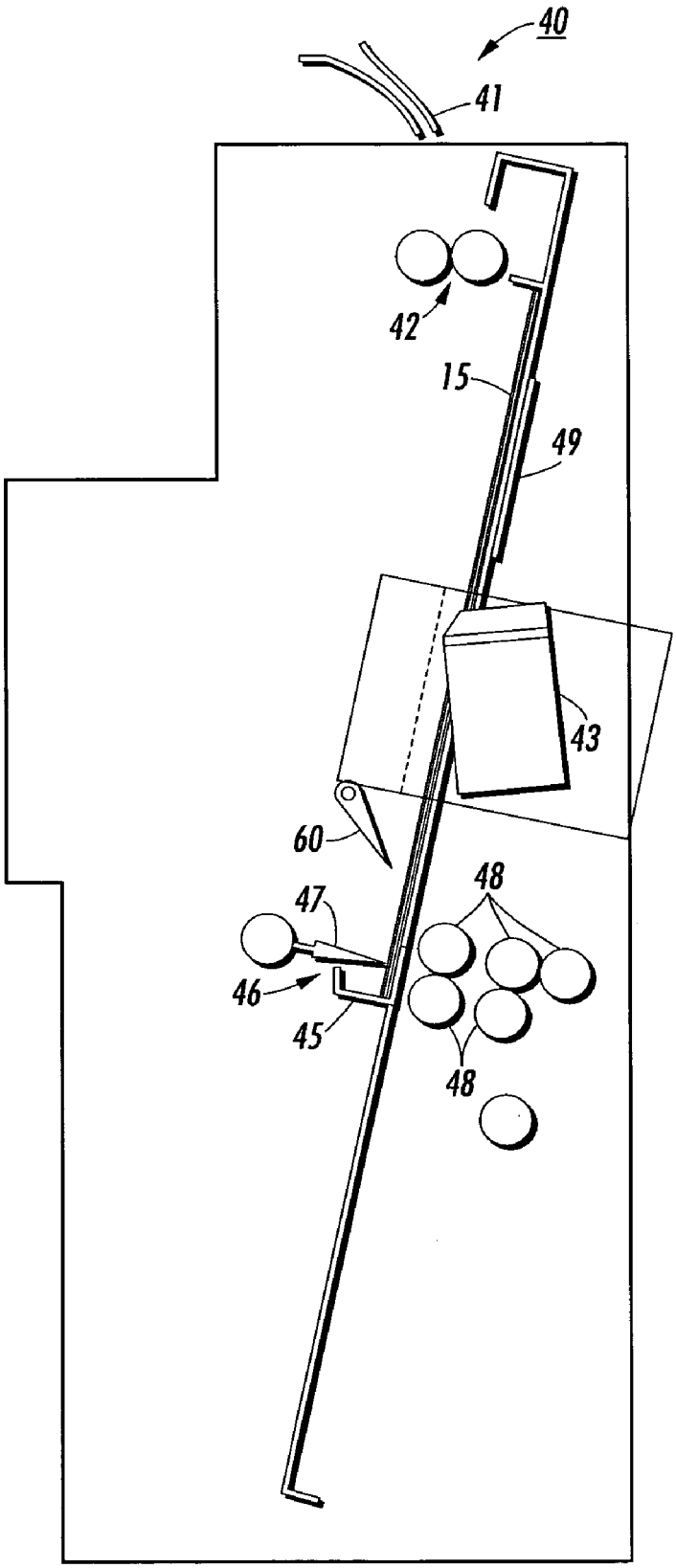
FIG. 5 is an elevation view of the booklet maker of FIG. 1 showing a stapler as it is fired.
Figure 6:
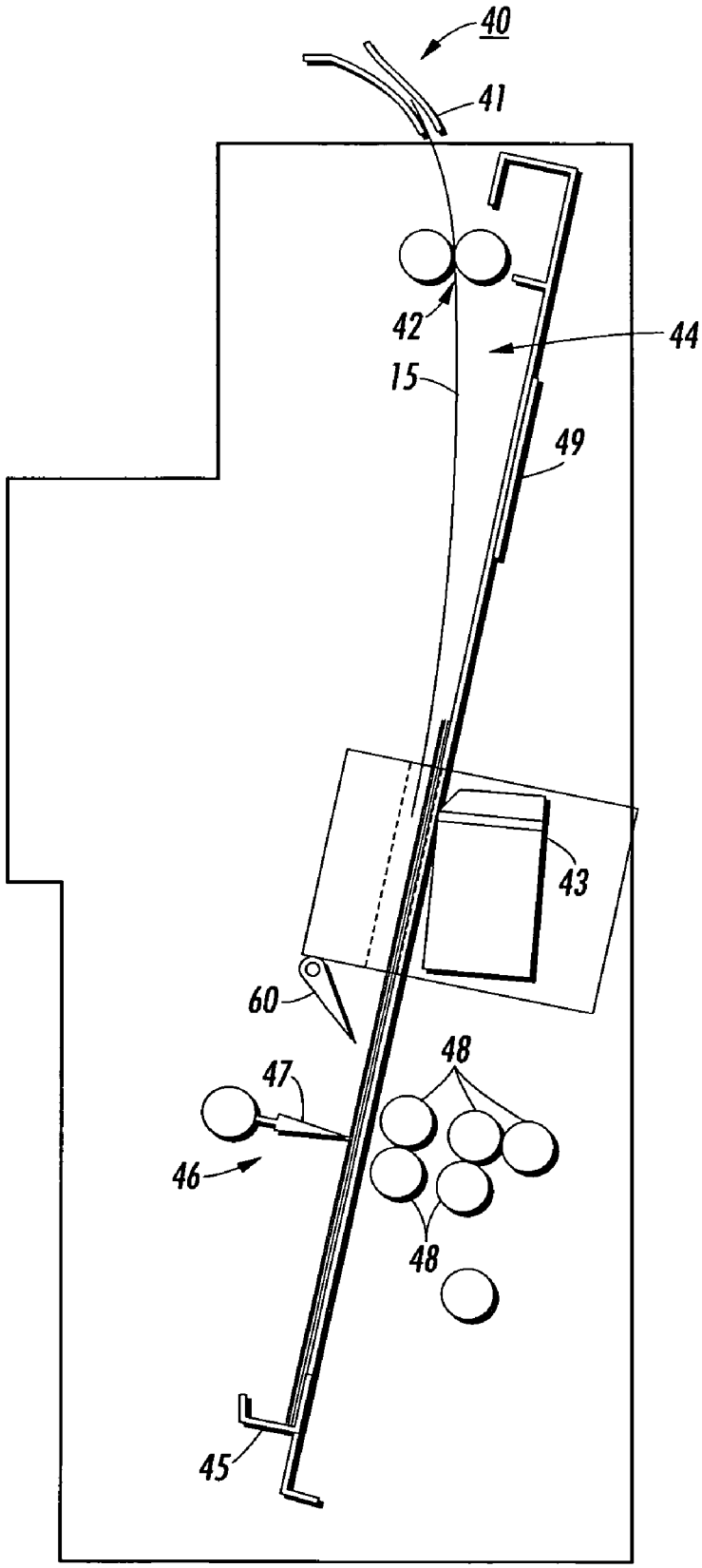
FIG. 6 is an elevation view of the booklet maker of FIG. 1 showing the backstop moved to a creasing position.

After a sheet set is accumulated in the cavity 44, as shown in FIG. 4, a tamper 49 is actuated to align the sheets for stapling and backstop 45 is moved by conventional means, such as, a rack and pinion mechanism or elevator movable (by means not shown, but typically including a motor or solenoid) to move the sheet set to a stapling position, while simultaneously, stapler 43 and crease module 46 are moved by similar conventional means (not shown) to a lower position. The sheet set is held by backstop 45 at a level where a stapler 43 can staple the sheets along a midline of the signatures, the midline corresponding to the eventual crease of the finished booklet. As shown in FIG. 5, at this time, stapler 43 fires to staple the sheet set and backstop 45 in FIG. 6 moves to the creasing position with the stapled sheet set. Sheets of a new set are simultaneously driven into the compiling cavity 44 with the now stapled sheet set serving to additionally dampen the incoming sheets. Stapler 43 moves separately from backstop 45 so that gate 60 is in the correct position relative to incoming sheets driven by drive nip 42.

Figure 7:
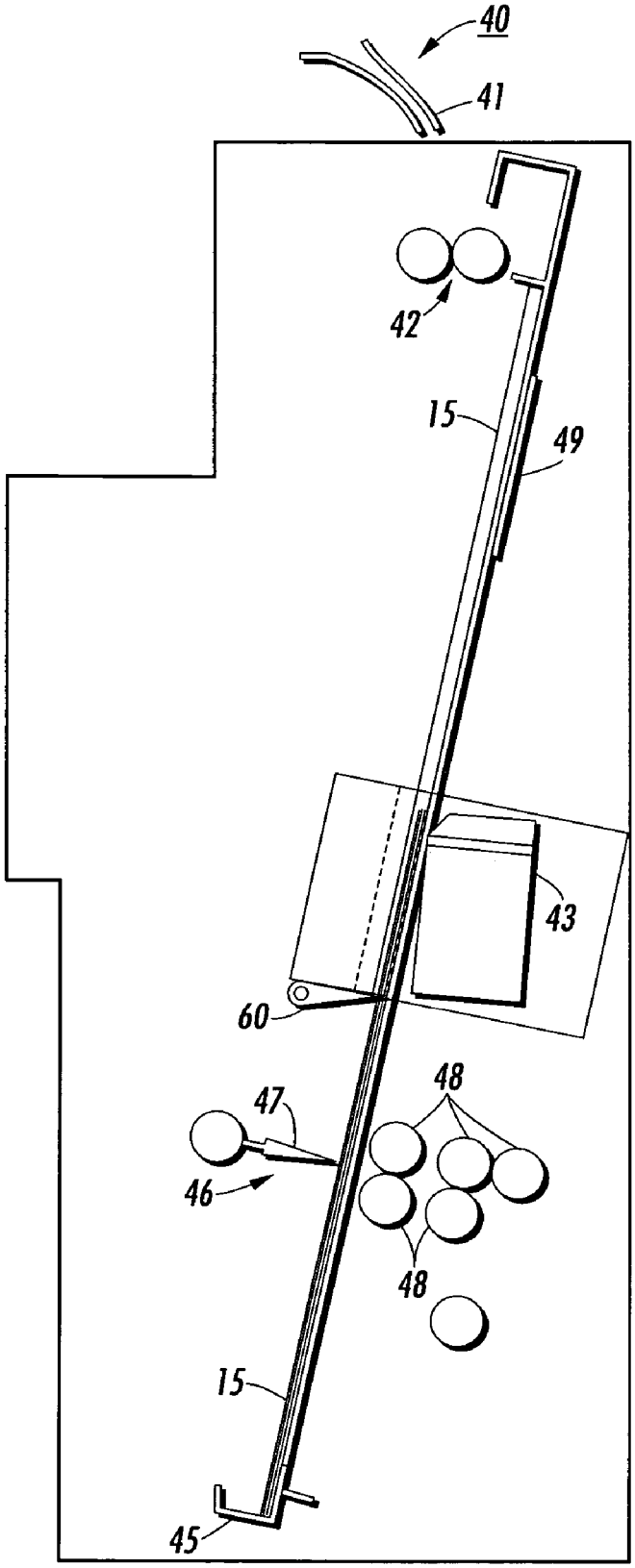
FIG. 7 is an elevation view of the booklet maker of FIG. 1 showing a gate acting as a backstop.
Figure 8:
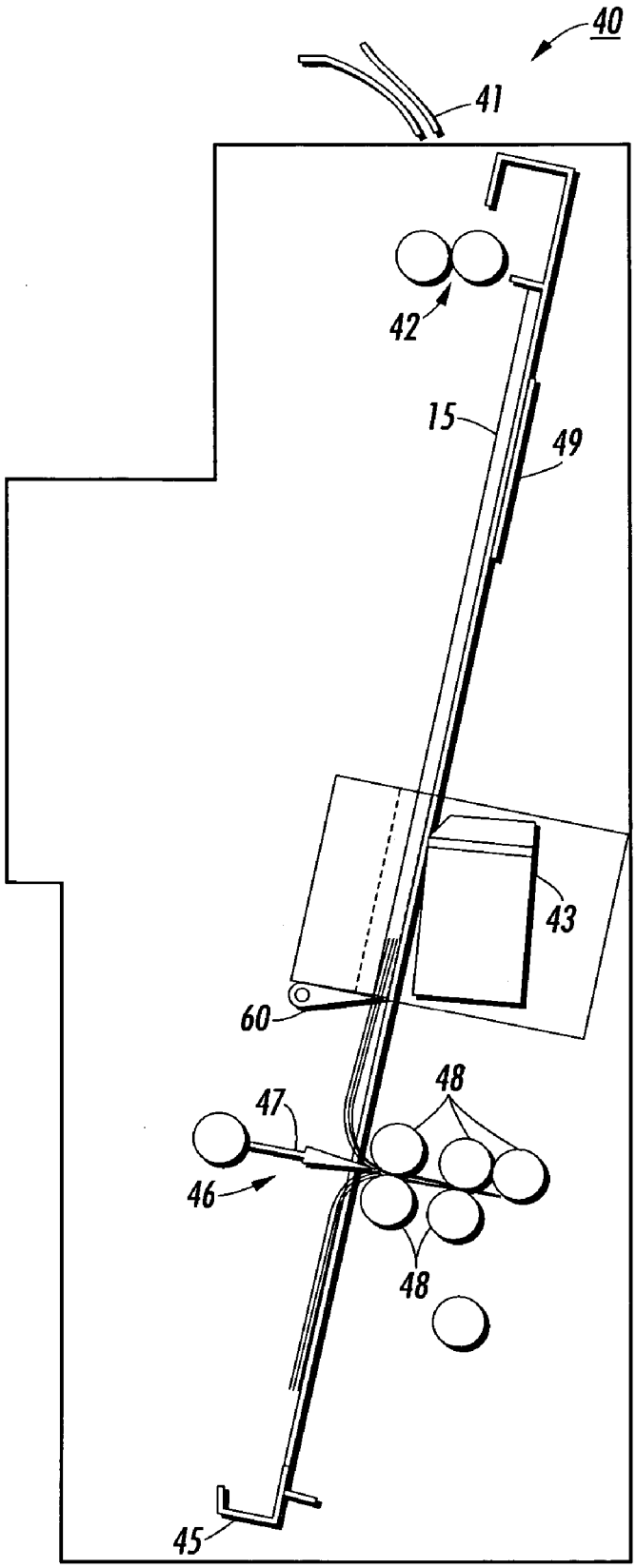
FIG. 8 is an elevation view of the booklet maker of FIG. 1 showing the set as it is creased.
Figure 9:
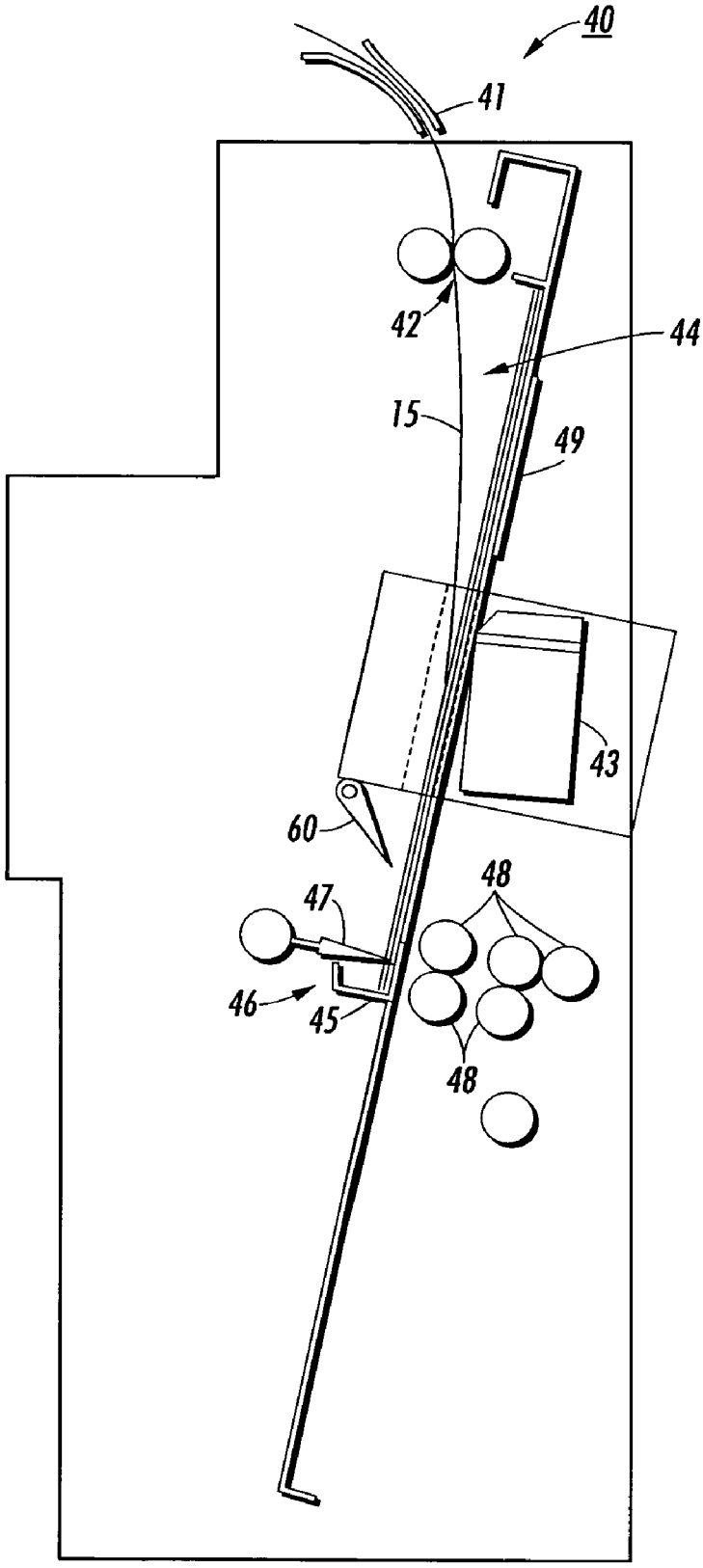
FIG. 9 is an elevation view of the booklet maker of FIG. 1 showing the backstop, stapler and crease module moved to an upper position.

Gate 60 is actuated, as shown in FIG. 7, to act as a temporary backstop for the new incoming sheet set and traps the lead edge of the incoming sheets. As the sheets of the incoming set are accumulating against gate 60, blade 47 of crease module 46 is actuated, as shown in FIG. 8. The action of blade 47 and crease rolls 48 perform the final folding, and sharp creasing, of the original sheet set into a finished booklet. Blade 47 contacts the sheet set along the stapled midpoint thereof, and bends the sheet set toward the nip of crease rolls 48, which draws all of the sheets in and forms a sharp crease. The crease and stapled sheet set is then drawn, by the rotation of crease rolls 48, completely through the nips, to form the final main fold in the finished booklet. The finished booklets are then collected in a stacker 70 as shown in FIG. 1. Subsequently, the incoming sheet set is gripped at the top to maintain its position by conventional means (not shown) while simultaneously, as shown in FIG. 9, gate 60 is deactuated and stapler 43 and crease module 46 are moved to the upper position. Backstop 45 is simultaneously moved upward as incoming sheets continue to be driven by nip 42 into the compiling tray. After backstop 45 has reached position to support the lead edge of the incoming set, the upper grip is released to allow incoming sheets to continue compiling.

It should now be understood that an improved booklet maker has been disclosed that combines the two functions of stapling and creasing into one module that moves to various positions during the booklet making sequence, and the compiling function into another module that is movable to multiple positions. Thus, the compiling function can occur in parallel while the stapling and creasing function proceeds. A gating system is used that employs the previous copy sheet set as part of a buffering system. These overlapping functions result in a highly significant productivity gain (no skipped pitches) without significantly increasing the product footprint.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A method for increasing bookmaking productivity in a printer, comprising:

providing a scanning member positioned to read images on documents positioned thereover and forward image data for further processing;

providing an image processor that receives the image data from said scanning member and processing it;

providing at least one copy sheet feed tray adapted to feed copy sheets to receive images thereon from said image processor;

providing a finishing system adapted to receive the imaged copy sheets, said finishing system including a movable backstop for supporting incoming sheets, a movable stapler and a moveable creasing module; and moving said backstop to a stapling position while simultaneously moving said stapler and creasing module from a first position to a creasing position.

2. The method of claim 1, including moving said backstop to said creasing position after said stapler is fired.

3. The method of claim 2, including providing a gate that is actuated to support incoming sheets while said backstop is moved to said creasing position.

* * * * *